US011641968B1

(12) United States Patent
Zou et al.

(10) Patent No.: US 11,641,968 B1
(45) Date of Patent: May 9, 2023

(54) ROTATABLE ELECTRIC MOUNTING BASE AND ARTIFICIAL TREE USING ELECTRIC MOUNTING BASE

(71) Applicants: Xinjiang Zou, Meizhou (CN); Lingong Wang, Nanyang (CN)

(72) Inventors: Xinjiang Zou, Meizhou (CN); Lingong Wang, Nanyang (CN)

( * ) Notice: Subject to any disclaimer, the term of this patent is extended or adjusted under 35 U.S.C. 154(b) by 0 days.

(21) Appl. No.: 17/946,408

(22) Filed: Sep. 16, 2022

(51) Int. Cl.

| | |
|---|---|
| ***A47G 33/06*** | (2006.01) |
| ***F21S 4/10*** | (2016.01) |
| ***A47G 33/08*** | (2006.01) |
| ***A47G 33/12*** | (2006.01) |
| ***F21W 121/04*** | (2006.01) |

(52) U.S. Cl.
CPC ..... *A47G 33/06* (2013.01); *A47G 33/08* (2013.01); *A47G 33/126* (2013.01); *F21S 4/10* (2016.01); *A47G 2033/0827* (2013.01); *A47G 2033/122* (2013.01); *F21W 2121/04* (2013.01)

(58) Field of Classification Search
CPC ..... A47G 33/06; A47G 33/08; A47G 33/126; A47G 2033/0827; A47G 2033/122; F21S 4/10
See application file for complete search history.

(56) References Cited

U.S. PATENT DOCUMENTS

| | | | | |
|---|---|---|---|---|
| 5,255,886 A * | 10/1993 | Wang | H01R 39/64 248/522 |
| 5,979,859 A * | 11/1999 | Vartanov | F16M 11/08 248/522 |
| 8,100,546 B2 * | 1/2012 | Lutz | A47G 33/06 40/414 |
| 2018/0131130 A1 * | 5/2018 | Stucchi | H01R 13/642 |

* cited by examiner

*Primary Examiner* — Matthew J. Peerce
(74) *Attorney, Agent, or Firm* — Georgi Korobanov

(57) ABSTRACT

The present disclosure discloses a rotatable electric mounting base and an artificial tree applying the electric mounting base. The rotatable electric mounting base includes a base main body and a mounting shaft. The mounting shaft is inserted into the main body mounting hole of the base main body. An electric device is mounted on the periphery of the mounting shaft in a sleeving mode. The electric device includes an upper joint component and a lower joint component. The rotatable electric mounting base has a novel structural design, good stability and reliability, and convenience in mounting and connecting. The artificial tree includes an artificial tree main body, a decorative light string, and the abovementioned rotatable electric mounting base.

10 Claims, 10 Drawing Sheets

ROTATABLE ELECTRIC MOUNTING BASE AND ARTIFICIAL TREE USING ELECTRIC MOUNTING BASE

TECHNICAL FIELD

The present disclosure relates to the technical field of artificial trees, and in particular, to a rotatable electric mounting base and an artificial tree applying the electric mounting base.

BACKGROUND

During Christmas, in order to foil festive atmosphere, performing festive decorations by using Christmas trees (artificial trees) has already become a necessary matter for Christmas. In order to improve the decorativeness of the Christmas trees, light strings are often hung on the Christmas trees, and the light strings have also become necessary decorations for Christmas.

For a Christmas tree product that needs to be rotated, in order to avoid the winding of connecting wires, a conductive joint device that can realize rotation and can ensure electrical conduction needs to be mounted at a trunk position of a Christmas tree.

The U.S. invention patent application Ser. No. 17/078,122 is entitled a rapid conductive joint device for a Christmas tree, which includes an upper joint component and a lower joint component matched with the upper joint component. The upper joint component includes an upper joint main body. The lower joint component includes a lower joint main body that is connected to the upper joint main body in a sleeving mode for rotating circumferentially at 360°. The upper joint main body and the lower joint main body are respectively plastic insulating pieces. The upper joint main body is provided with an upper joint conductive piece. The upper joint conductive piece includes an annular contact part. The lower joint main body is provided with a lower joint conductive piece that is in contact with a circumferential surface of the annular contact part of the upper joint conductive piece. The lower joint conductive piece is provided with an elastic contact part that is in a curved shape and is protruded toward the annular contact part side of the corresponding upper joint conductive piece.

For the abovementioned rapid conductive joint device for a Christmas tree, the contact and electrical conduction of conductive pieces are realized through an elastic piece structure. In the case of deformation, the elastic piece structure will lead to unstable electrical conduction, that is, the elastic piece structure has the defect of poor stability and reliability.

SUMMARY

An objective of the present disclosure is to provide a rotatable electric mounting base for the deficiencies of the prior art. The rotatable electric mounting base has a novel structural design, good stability and reliability, and convenience in mounting and connecting.

Another objective of the present disclosure is to provide an artificial tree. The artificial tree has a novel structural design, good stability and reliability, and convenience in mounting and connecting.

To achieve the abovementioned objective, the present disclosure is implemented by the following technical solutions.

A rotatable electric mounting base includes a base main body and a mounting shaft arranged in the vertical direction. A main body mounting hole which completely penetrates up and down is formed in the central position of the base main body. A lower end of the mounting shaft is inserted into the main body mounting hole of the base main body. The base main body is provided with a driving motor. The driving motor is connected to the mounting shaft and drives the same.

An electric device is mounted on the periphery of the mounting shaft in a sleeving mode. The electric device includes an upper joint component and a lower joint component that is located on a lower end side of the upper joint component and is matched with the upper joint component. The upper joint component includes an upper joint main body mounted on the periphery of the mounting shaft in a sleeving mode. The lower joint component includes a lower joint main body that is connected to a lower end of the upper joint main body in a sleeving mode for rotating circumferentially at 360° and is mounted on the periphery of the mounting shaft in a sleeving mode. The lower joint main body is buckled and fastened to the base main body. The upper joint main body and the lower joint main body are respectively plastic insulating pieces.

The upper joint main body is provided with an upper joint connecting wire and an upper electric connecting piece that is in an annular shape and is arranged horizontally. The upper joint connecting wire is electrically connected to the upper electric connecting piece. The lower joint main body is provided with a lower joint connecting wire and a lower electric connecting piece that is in an annular shape and is arranged horizontally. The lower electric connecting piece is electrically connected to the lower joint connecting wire.

The upper joint component is provided with a conductive component at the lower end side of the upper electric connecting piece. The conductive component includes a metal conductive spring and a metal conductive pin located on the lower end side of the metal conductive spring. The lower end of the metal conductive spring is pressed against the upper end of the metal conductive pin. The upper end of the metal conductive spring is pressed against and is electrically conducted with the upper electric connecting piece. The lower end of the metal conductive pin is in contact with the lower electric connecting piece and is electrically conducted with the lower electric connecting piece.

The upper electric connecting piece is an upper PCB that is in an annular shape and is arranged horizontally. An upper inner conductive layer and an upper outer conductive layer which are respectively in annular shapes are arranged on a lower surface of the upper PCB. The upper inner conductive layer and the upper outer conductive layer are arranged at an interval. The upper joint connecting wire is electrically connected to each of the upper inner conductive layer and the upper outer conductive layer.

The lower electric connecting piece is a lower PCB that is in an annular shape and is arranged horizontally. A lower inner conductive layer and a lower outer conductive layer which are respectively in annular shapes are arranged on an upper surface of the lower PCB. The lower inner conductive layer and the lower outer conductive layer are arranged at an interval. The lower joint connecting wire is electrically connected to each of the lower inner conductive layer and the lower outer conductive layer. The upper inner conductive layer and the lower inner conductive layer are aligned in the vertical direction. The upper outer conductive layer and the lower outer conductive layer are aligned in the vertical direction.

The conductive component includes an inner conductive component and an outer conductive component. The inner conductive component and the outer conductive component respectively include a metal conductive spring and a metal conductive pin located on the lower end side of the metal conductive spring. The lower end of each metal conductive spring is pressed against the upper end of the corresponding metal conductive pin. The upper end of the metal conductive spring of the inner conductive component is pressed against the lower inner conductive layer. The lower end of the metal conductive pin of the inner conductive component is in contact with the lower inner conductive layer. The upper end of the metal conductive spring of the outer conductive component is pressed against the upper outer conductive layer. The lower end of the metal conductive pin of the outer conductive component is in contact with the lower outer conductive layer.

An upper bearing and a lower bearing located on a lower end side of the upper bearing are mounted at the lower end of the mounting shaft in a sleeving mode. A main body upper shoulder and a main body lower shoulder located on a lower end side of the main body upper shoulder are arranged on an e wall of the main body mounting hole. The upper bearing is pressed against and limited at the main body upper shoulder. The lower bearing is pressed against and limited at the main body lower shoulder.

The driving motor is screwed and fastened to the lower end of the base main body. A power output shaft of the driving motor is connected to the lower end of the mounting shaft and drives the same.

A driving piece is welded at the lower end of the mounting shaft. A D-shaped hole is formed in the central position of the driving piece. A flat part consistent with the shape of the D-shaped hole is arranged at the upper end of a power output shaft of the driving motor. The flat part of the power output shaft of the driving motor is inserted into the D-shaped hole of the driving piece.

The upper inner conductive layer and the upper outer conductive layer are respectively metal conductive layers arranged on the lower surface of the upper PCB.

The lower inner conductive layer and the lower outer conductive layer are respectively metal conductive layers arranged on the upper surface of the lower PCB.

The upper joint main body is provided with component mounting holes corresponding to the inner conductive component and the outer conductive component respectively. The inner conductive component and the outer conductive component are respectively inserted into the component mounting holes.

A main body limiting shoulder is formed on an inner wall of each component mounting hole. Each metal conductive pin is provided with a conductive pin limiting shoulder. The conductive pin limiting shoulder of each metal conductive pin is located on an upper end side of the corresponding main body limiting shoulder.

An upper joint cover body mounted on the periphery of the mounting shaft in a sleeving mode is screwed and fastened to the upper joint main body. The upper PCB is clamped and fixed between the upper joint cover body and the upper joint main body.

The lower joint main body is buckled with a fixing retaining ring located at an upper end side of the lower PCB. The fixing retaining ring is in an annular shape and is mounted on the periphery of the mounting shaft in a sleeving mode. The lower PCB is clamped and fastened between the fixing retaining ring and the lower joint main body.

An artificial tree includes an artificial tree main body, and a decorative light string mounted on the artificial tree main body. The decorative light string is provided with a light string connecting wire. The artificial tree main body is provided with a trunk part.

The artificial tree further includes the abovementioned rotatable electric mounting base. The upper joint connecting wire and the light string connecting wire are connected through a butt joint and realize electrical conduction. The trunk part of the artificial tree main body is connected to the upper end of the mounting shaft.

An insertion hole with an upward opening is formed in the core of the mounting shaft. The trunk part of the artificial tree main body is inserted into the insertion hole of the mounting shaft.

The present disclosure has the beneficial effects that: the rotatable electric mounting base described in the present disclosure includes a base main body and a mounting shaft arranged in the vertical direction. A main body mounting hole which completely penetrates up and down is formed in the central position of the base main body. The lower end of the mounting shaft is inserted into the main body mounting hole of the base main body. The base main body is provided with a driving motor. The driving motor is connected to the mounting shaft and drives the same. An electric device is mounted on the periphery of the mounting shaft in a sleeving mode. The electric device includes an upper joint component and a lower joint component that is located on a lower end side of the upper joint component and is matched with the upper joint component. The upper joint component includes an upper joint main body mounted on the periphery of the mounting shaft in a sleeving mode. The lower joint component includes a lower joint main body that is connected to a lower end of the upper joint main body in a sleeving mode for rotating circumferentially at 360° and is mounted on the periphery of the mounting shaft in a sleeving mode. The lower joint main body is buckled and fastened to the base main body. The upper joint main body and the lower joint main body are respectively plastic insulating pieces. The upper joint main body is provided with an upper joint connecting wire and an upper electric connecting piece that is in an annular shape and is arranged horizontally. The upper joint connecting wire is electrically connected to the upper electric connecting piece. The lower joint main body is provided with a lower joint connecting wire and a lower electric connecting piece that is in an annular shape and is arranged horizontally. The lower electric connecting piece is electrically connected to the lower joint connecting wire. The upper joint component is provided with a conductive component at the lower end side of the upper electric connecting piece. The conductive component includes a metal conductive spring and a metal conductive pin located on the lower end side of the metal conductive spring. The lower end of the metal conductive spring is pressed against the upper end of the metal conductive pin. The upper end of the metal conductive spring is pressed against and is electrically conducted with the upper electric connecting piece. The lower end of the metal conductive pin is in contact with the lower electric connecting piece and is electrically conducted with the lower electric connecting piece. Through the abovementioned structural design, the rotatable electric mounting base has the advantages of novel structural design, good stability and reliability, and convenience in mounting and connecting.

The present disclosure has another beneficial effect that: the artificial tree described in the present disclosure includes an artificial tree main body, and a decorative light string mounted on the artificial tree main body. The decorative light string is provided with a light siring connecting wire. The artificial tree main body is provided with a trunk part. The artificial tree further includes the abovementioned rotatable electric mounting base. The upper joint connecting wire and the light string connecting wire are connected through a butt joint and realize electrical conduction. The trunk part of the artificial tree main body is connected to the upper end of the mounting shaft. Through the abovementioned structural design, the artificial tree of the present disclosure has the advantages of novel structural design, good stability and reliability, and convenience in mounting and connecting.

BRIEF DESCRIPTION OF DRAWINGS

The present disclosure will be further described below by using accompanying drawings, but the embodiments in the accompanying drawings do not constitute any limitation to the present disclosure.

FIG. 1 to FIG. 10 includes:

Figure 1:
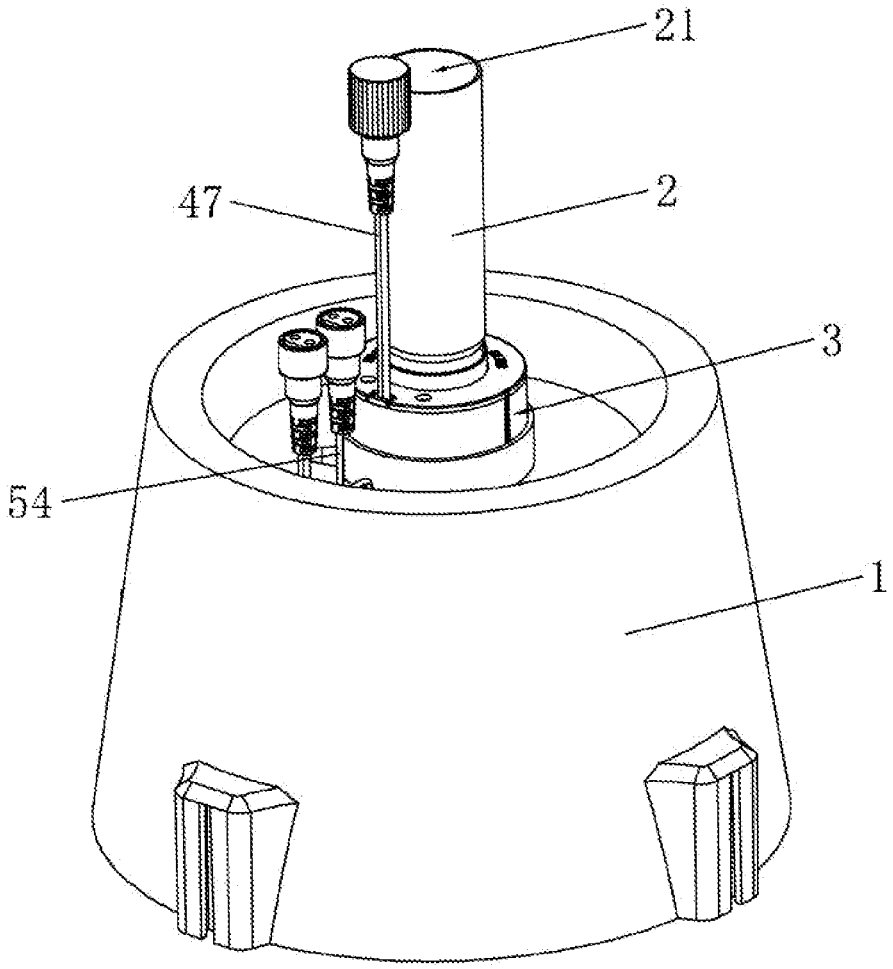
FIG. 1 is a schematic structural diagram of a rotatable electric mounting base of the present disclosure.

| | |
|---|---|
| 1-base main body | 11-main body mounting hole |
| 121-main body upper shoulder | 122-main body lower shoulder |
| 2-mounting shaft | 21-insertion hole |
| 3-electric device | 4-upper joint component |
| 41-upper joint main body | 411-component mounting hole |
| 4111-main body limiting shoulder | 42-upper PCB |
| 421-upper inner conductive layer | 422-upper outer conductive layer |
| 43-inner conductive component | 44-outer conductive component |
| 451-metal conductive spring | 452-metal conductive pin |
| 4521-conductive pin limiting shoulder | 46-upper joint cover body |
| 47-upper joint connecting wire | 5-lower joint component |
| 51-lower joint main body | 52-lower PCB |
| 521-lower inner conductive layer | 522-lower outer conductive layer |
| 53-fixing retaining ring | 54-lower joint connecting wire |
| 61-upper bearing | 62-lower bearing |
| 71-driving motor | 711-flat part |
| 72-driving piece | 721-D-shaped hole |
| 8-artificial tree main body | 81-trunk part |
| 9-decorative light string | 91-string light connecting wire |

DETAILED DESCRIPTION

The present disclosure will be described below in combination with specific implementation modes.

As shown in FIG. 1 to FIG. 7, a rotatable electric mounting base includes a base main body 1 and a mounting shaft 2 arranged in the vertical direction. A main body mounting hole 11 which completely penetrates up and down is formed in the central position of the base main body 1. A lower end of the mounting shaft 2 is inserted into the main body mounting hole 11 of the base main body 1. The base main body 1 is provided with a driving motor 71. The driving motor 71 is connected to the mounting shaft 2 and drives the same. The driving motor 71 is used for driving the mounting shaft 2 to rotate.

An electric device 3 is mounted on the periphery of the mounting shaft 2 in a sleeving mode. The electric device 3 includes an upper joint component 4 and a lower joint component 5 that is located on a lower end side of the upper joint component 4 and is matched with the upper joint component 4. The upper joint component 4 includes an upper joint main body 41 mounted on the periphery of the mounting shaft 2 in a sleeving mode. The lower joint component 5 includes a lower joint main body 51 that is connected to a lower end of the upper joint main body 41 in a sleeving mode for circumferentially rotating at 360° and is mounted on the periphery of the mounting shaft 2 in a sleeving mode. The lower joint main body 51 is buckled and fastened to the base main body 1, The upper joint main body 41 and the lower joint main body 51 are respectively plastic insulating pieces.

Further, the upper joint main body 41 is provided with an upper joint connecting wire 47 and an upper electric connecting piece that is in an annular shape and is arranged horizontally. The upper joint connecting wire 47 is electrically connected to the upper electric connecting piece. The lower joint main body 51 is provided with a lower joint connecting wire 54 and a lower electric connecting piece that is in an annular shape and is arranged horizontally. The lower electric connecting piece is electrically connected to the lower joint connecting wire 54.

Furthermore, the upper joint component 4 is provided with a conductive component at the lower end side of the upper electric connecting piece. The conductive component includes a metal conductive spring 451 and a metal conductive pin 452 located on the lower end side of the metal conductive spring 451. The lower end of the metal conductive spring 451 is pressed against the upper end of the metal conductive pin 452. The upper end of the metal conductive spring 451 is pressed against and is electrically conducted with the upper electric connecting piece. The lower end of the metal conductive pin 452 is in contact with the lower electric connecting piece and is electrically conducted with the lower electric connecting piece.

Specifically: the upper electric connecting piece is an upper PCB 42 that is in an annular shape and is arranged horizontally. An upper inner conductive layer 421 and an upper outer conductive layer 422 which are respectively in annular shapes are arranged on a lower surface of the upper PCB 42. The upper inner conductive layer 421 and the upper outer conductive layer 422 are arranged at an interval. The upper joint connecting wire 47 is electrically connected to each of the upper inner conductive layer 421 and the upper outer conductive layer 422, The lower electric connecting piece is a lower PCB 52 that is in an annular shape and is arranged horizontally. A lower inner conductive layer 521 and a lower outer conductive layer 522 which are respectively in annular shapes are arranged on an upper surface of the lower PCB 52, The lower inner conductive layer 521 and the lower outer conductive layer 522 are arranged at an interval. The lower joint connecting wire 54 is electrically connected to each of the lower inner conductive layer 521 and the lower outer conductive layer 522. The upper inner conductive layer 421 and the lower inner conductive layer 521 are aligned in the vertical direction. The upper outer conductive layer 422 and the lower outer conductive layer 522 are aligned in the vertical direction. The conductive component includes an inner conductive component 43 and an outer conductive component 44. The inner conductive component 43 and the outer conductive component 44 respectively include a metal conductive spring 451 and a metal conductive pin 452 located on the lower end side of the metal conductive spring 451. The lower end of each metal conductive spring 451 is pressed against the upper end of the corresponding metal conductive pin 452. The upper end of the metal conductive spring 451 of the inner conductive component 43 is pressed against the lower inner conductive layer 421. The lower end of the metal conductive pin 452 of the inner conductive component 43 is in contact with the lower inner conductive layer 521. The upper end of the metal conductive spring 451 of the outer conductive component 44 is pressed against the upper outer conductive layer 422. The lower end of the metal conductive pin 452 of the outer conductive component 44 is in contact with the lower outer conductive layer 522.

It is to be noted that specific structures of the abovementioned upper electric connecting piece and the lower electric connecting piece do not constitute a limitation to the present disclosure, that is, the upper electric connecting piece and the lower electric connecting piece of the present disclosure may also in other structural forms.

During using the rotatable electric mounting base of the present disclosure, the upper end of the mounting shaft 2 is used for mounting the artificial tree. The decorative light string 9 on the artificial tree is connected to the upper joint connecting wire 47 through a corresponding light string connecting wire 91. The mounting shaft 2 rotates under the driving action of the driving motor 71. The electric device 3 is mounted on the periphery of the mounting shaft 2 in a sleeving mode. The lower joint main body 51 is screwed on the base main body 1. The lower joint main body 51 is connected to the lower end of the upper joint main body 41 in a sleeving mode for circumferentially rotating at 360°. When the artificial tree needs to be rotated, the upper joint main body 41 rotates along with the artificial tree, which can effectively prevent the upper joint connecting wire 47 and the light string connecting wire 91 from winding.

For the electric device 3 of the present disclosure, during realizing electrical connection between the upper joint component 4 and the lower joint component 5, the upper joint component 4 is located above the lower joint component 5, the upper inner conductive layer 421 of the upper PCB 42 is electrically conducted with the lower inner conductive layer 521 of the lower PCB 52 through an inner conductive component 43, and the upper outer conductive layer 422 of the upper PCB 42 is electrically conducted with the lower outer conductive layer 522 of the upper PCB 42 through an outer conductive component 44, Since various metal conductive pins 452 are respectively pressed downwards through corresponding metal conductive springs 451, during rotating the upper joint component 4 relative to the lower joint component 5 under the action of an elastic force of the metal conductive spring 451, the metal conductive pin 452 of the inner conductive component 43 is kept in contact with and pressing against the lower inner conductive layer 521 of the lower PCB 52, and the metal conductive pin 452 of the outer conductive component 44 is kept in contact with and pressing against the lower outer conductive layer 522 of the lower PCB 52.

It is to be emphasized that, compared with the prior art, the electric device 3 of the present disclosure does not have unstable electrical conduction caused by the deformation of a contact elastic piece.

In addition, during mounting the artificial tree on the rotatable electric mounting base of the present disclosure, only the trunk part 81 of the artificial tree needs to be mounted on an upper end of the mounting shaft 2, and the light string connecting wire 91 of the decorative light string 9 needs to be connected to the upper joint connecting wire 47, so the mounting and connecting are convenient.

It can be known from the abovementioned conditions that, through the abovementioned structural design, the present disclosure has the advantages of novel structural design, good stability and reliability, and convenience in mounting and connecting.

Figure 2:
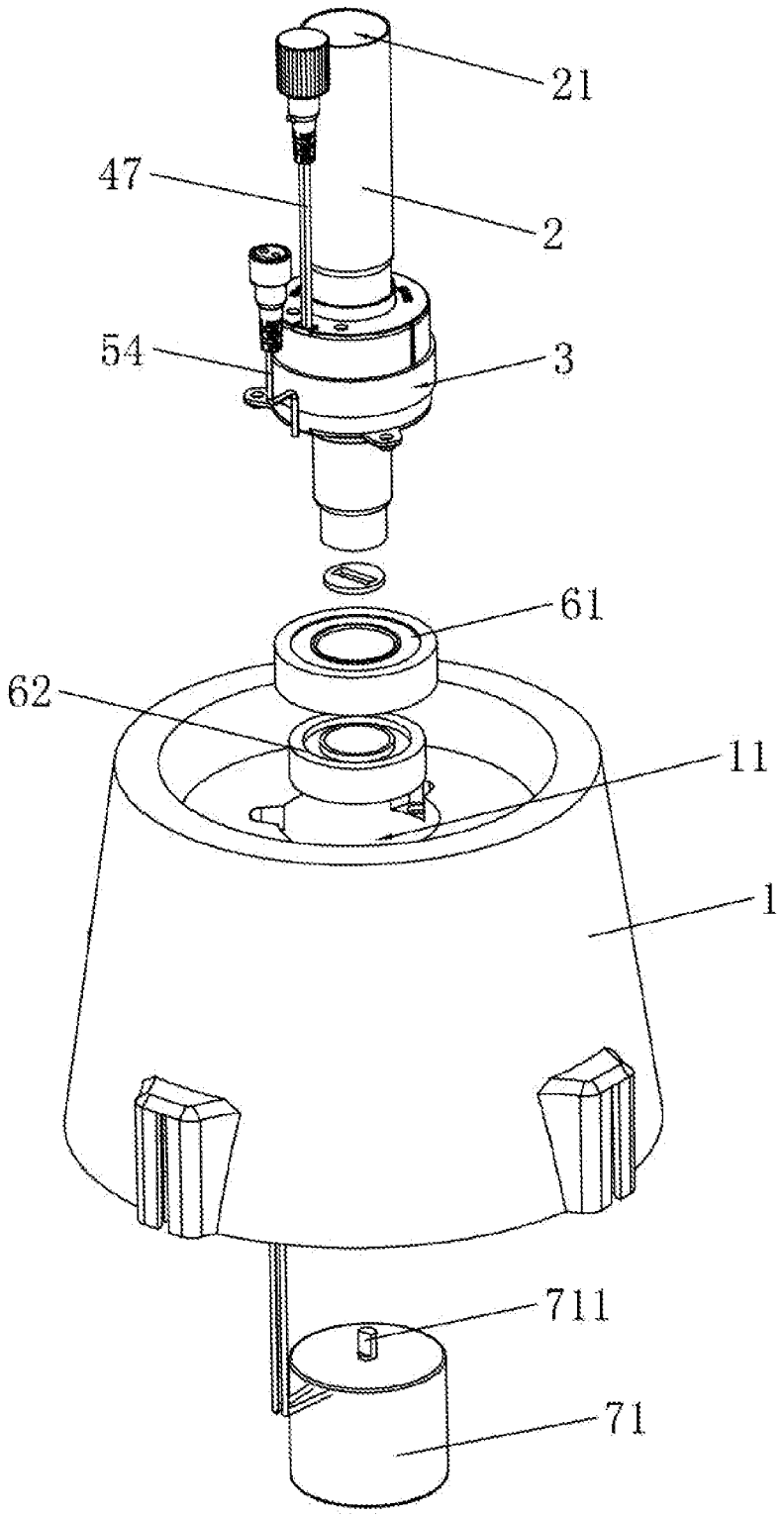
FIG. 2 is a schematic exploded diagram of the rotatable electric mounting base of the present disclosure.
Figure 3:
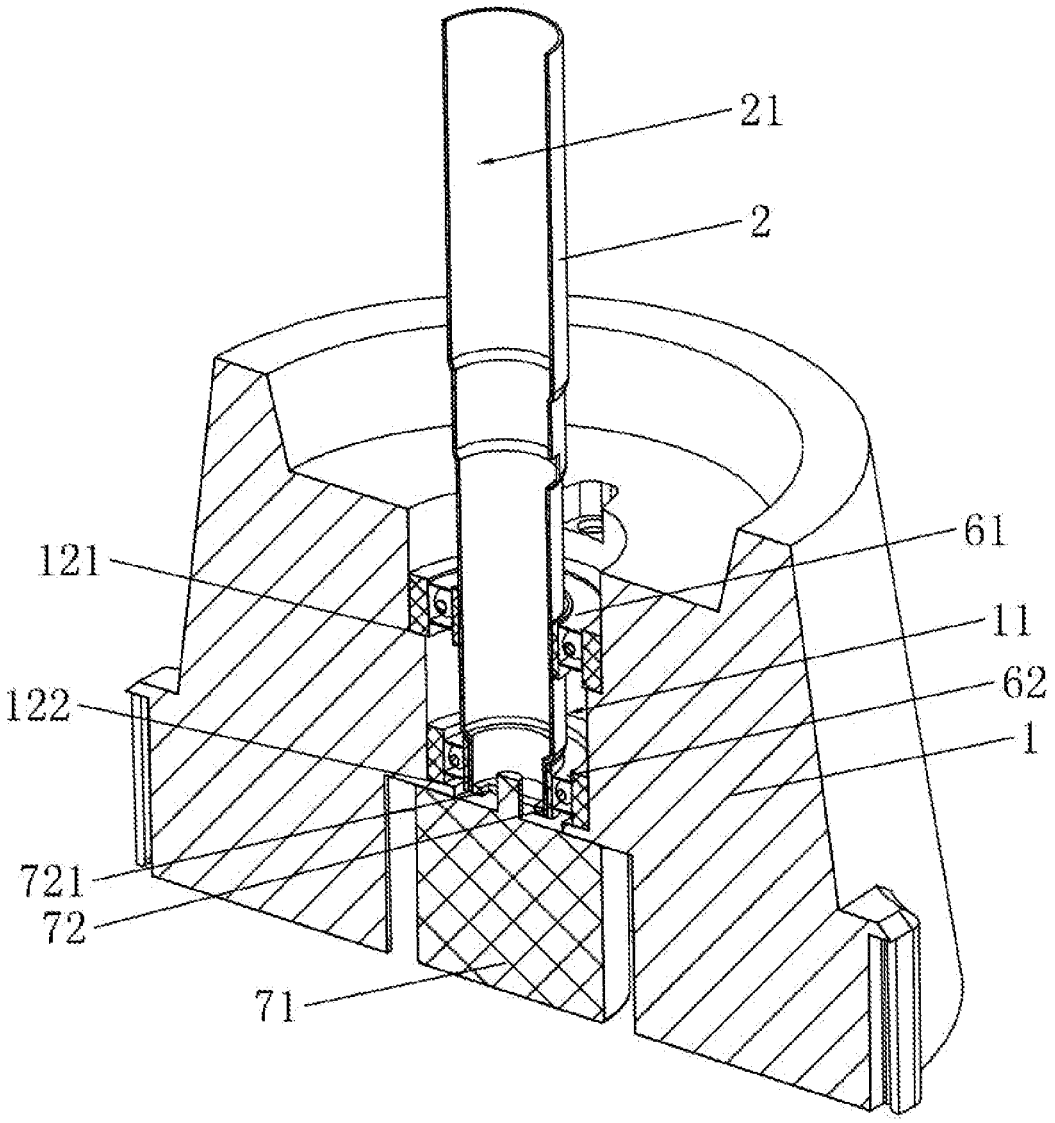
FIG. 3 is a schematic cross-sectional view of the rotatable electric mounting base of the present disclosure.
Figure 4:
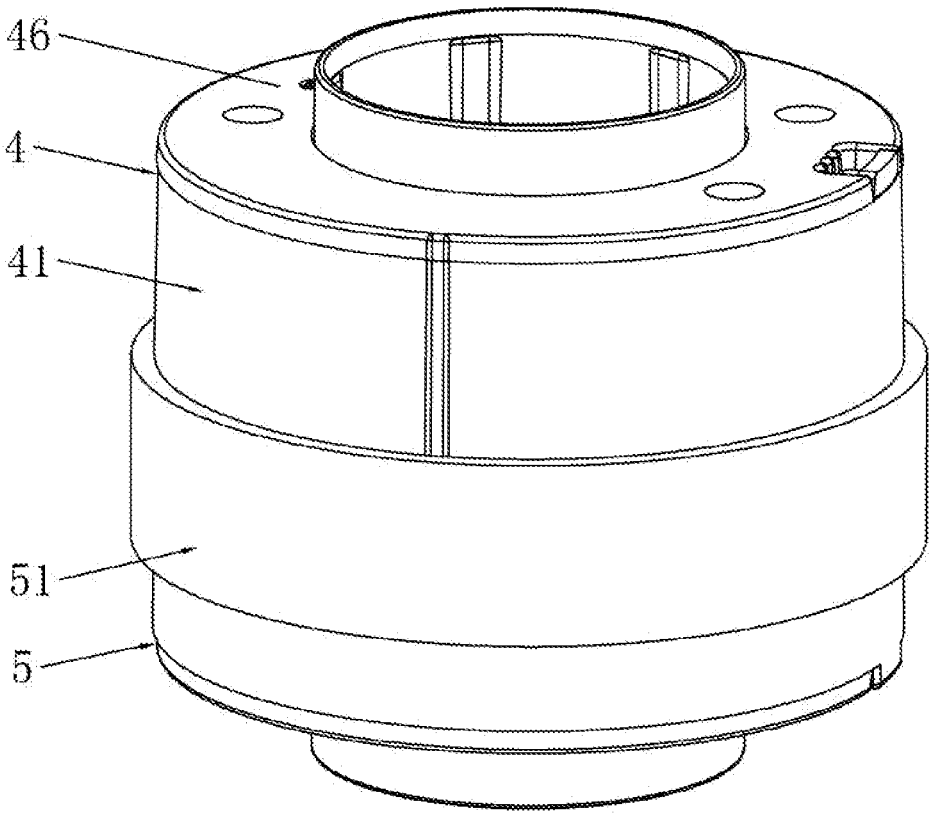
FIG. 4 is a schematic structural diagram of an electric device of the present disclosure.

As a preferred implementation mode, as shown in FIG. 2 and FIG. 3, the lower end of the mounting shaft 2 of the present disclosure may be mounted in the main body mounting hole 11 of the base main body 1 in the following modes, specifically: an upper bearing 61 and a lower bearing 62 located on a lower end side of the upper bearing 61 are mounted at the lower end of the mounting shaft 2 in a sleeving mode; a main body upper shoulder 121 and a main body lower shoulder 122 located on a lower end side of the main body upper shoulder 121 are arranged on an inner wall of the main body mounting hole 11; the upper bearing 61 is pressed against and limited at the main body upper shoulder 121; and the lower bearing 62 is pressed against and limited at the main body lower shoulder 122.

As a preferred implementation mode, as shown in FIG. 2 and FIG. 3, the driving motor 71 is screwed and fastened to the lower end of the base main body 1. A power output shaft of the driving motor 71 is connected to the lower end of the mounting shaft 2 and drives the same.

Specifically, the driving motor 71 of the present disclosure may be connected to the lower end of the mounting shaft (2) and drives the same in the following modes, specifically: a driving piece 72 is welded at the lower end of the mounting shaft 2; a D-shaped hole 721 is formed in the central position of the driving piece 72; a flat part 711 consistent with the shape of the D-shaped hole 721 is arranged at the upper end of a power output shaft of the driving motor 71; and the flat part 711 of the power output shaft of the driving motor 71 is inserted into the D-shaped hole 721 of the driving piece 72. Of course, the abovementioned D-shaped hole 721 does not construe a limitation to the present disclosure. Hole structures in other shapes may also be formed in the central position of the driving piece 72. The shape of the upper end of the power output shaft of the driving motor 71 is consistent with those of the abovementioned hole structures.

For an artificial tree product that rotates automatically, during working, the driving motor 71 drives the mounting shaft 2 to rotate through the driving piece 72 after being powered on, the rotating mounting shaft 2 drives the artificial tree mounted at the upper end of the mounting shaft 2 to rotate, so that the artificial tree rotates automatically.

Figure 6:
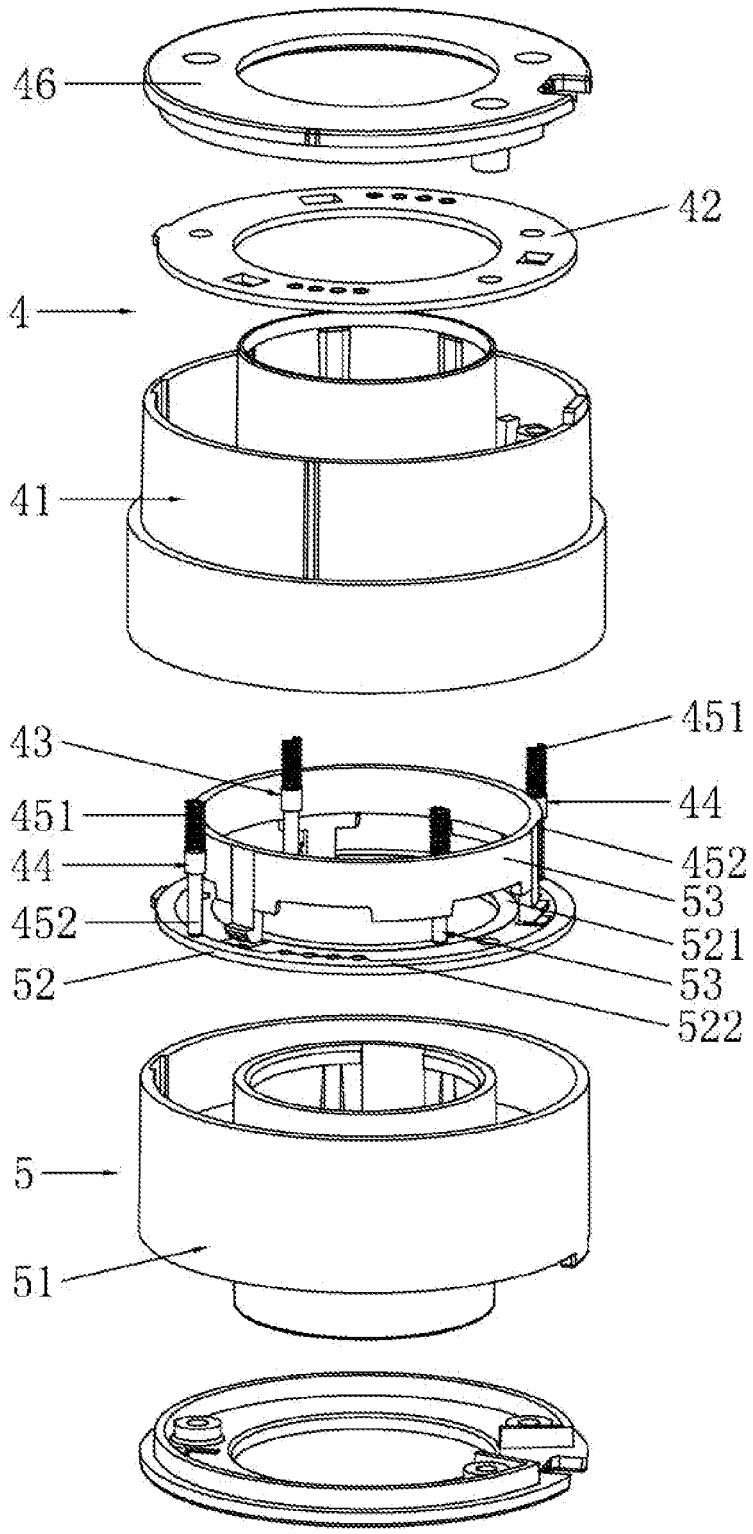
FIG. 6 is a schematic exploded diagram of the electric device of the present disclosure.
Figure 7:
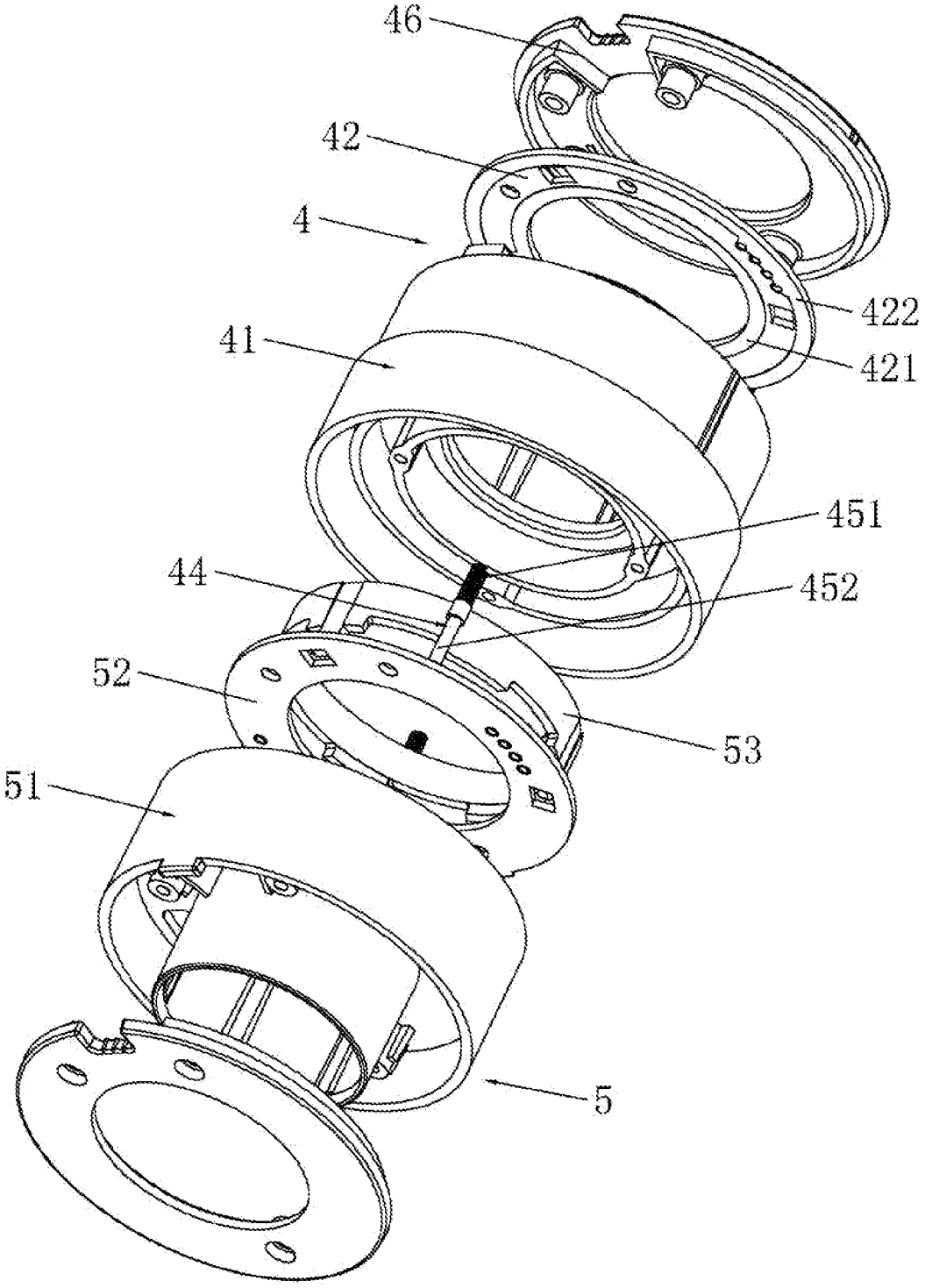
FIG. 7 is a schematic exploded diagram of the electric device in another perspective of the present disclosure.

As a preferred implementation mode, as shown in FIG. 6 and FIG. 7, the upper inner conductive layer 421 and the upper outer conductive layer 422 are respectively metal conductive layers arranged on the lower surface of the upper PCB 42; and similarly, the lower inner conductive layer 521 and the lower outer conductive layer 522 are respectively metal conductive layers arranged on the upper surface of the lower PCB 52.

Figure 5:
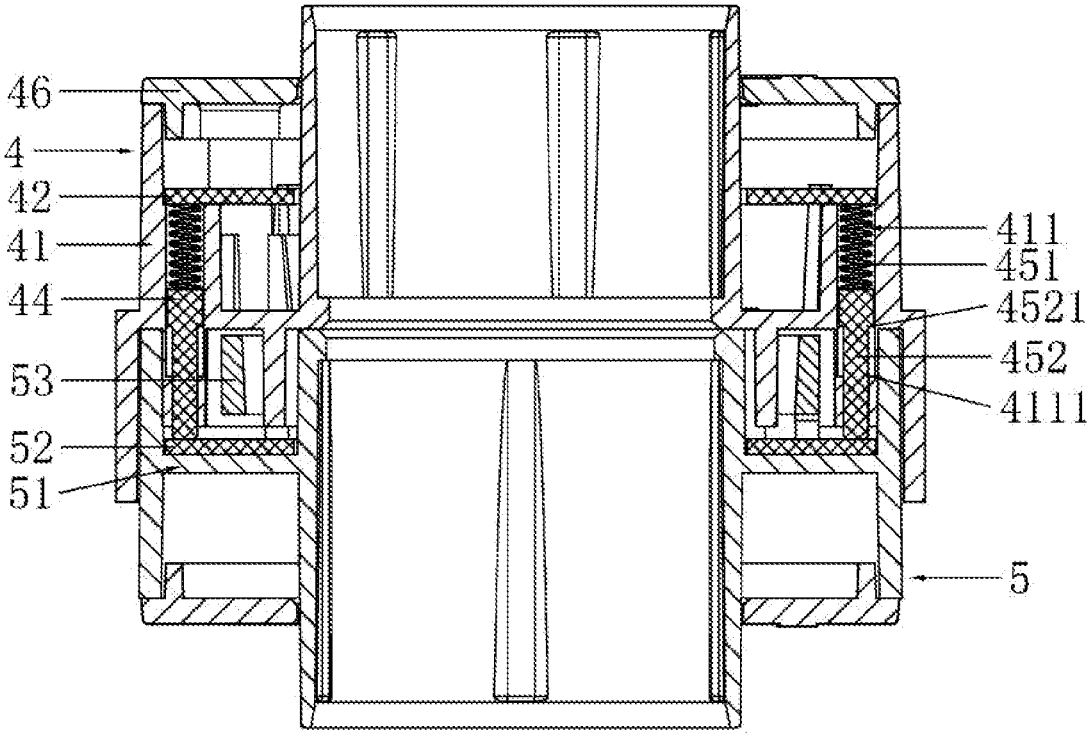
FIG. 5 is a schematic cross-sectional view of the electric device of the present disclosure.

As a preferred implementation mode, as shown in FIG. 5, the inner conductive component 43 and the outer conductive component 44 of the present disclosure may be mounted on the upper joint main body 41 in the following modes, specifically: the upper joint main body 41 is provided with component mounting holes 411 corresponding to the inner conductive component 43 and the outer conductive component 44 respectively; the inner conductive component 43 and the outer conductive component 44 are respectively embedded into the corresponding component mounting holes 411; a main body limiting shoulder 4111 is formed on an inner wall of each component mounting hole 411; each metal conductive pin 452 is provided with a conductive pin limiting shoulder 4521; and the conductive pin limiting shoulder 4521 of each metal conductive pin 452 is located on an upper end side of the corresponding main body limiting shoulder 4111.

For the inner conductive component 43 and the outer conductive component 44, the conductive pin limiting shoulder 4521 of each metal conductive pin 452 is located on the upper end side of the corresponding main body limiting shoulder 4111, so that when the metal conductive pin 452 moves to a limit position downwards relative to the upper joint main body 41, the conductive pin limiting shoulder 4521 of each metal conductive pin 452 is pressed against and limited at the main body limiting shoulder 4111 of the upper joint main body 41. That is, the metal conductive pin 452 is limited by matching the main body limiting shoulder 4111 and the conductive pin limiting shoulder 4521, so that the metal conductive pin 452 is prevented from withdrawing from the corresponding component mounting hole 411.

As a preferred implementation mode, as shown in FIG. 4 to FIG. 7, the upper PCB 42 of the present disclosure may be mounted on the upper joint main body 41 in the following modes, specifically: an upper joint cover body 46 mounted on the periphery of the mounting shaft 2 in a sleeving mode is screwed and fastened to the upper joint main body 41; and the upper PCB 42 is clamped and fixed between the upper joint cover body 46 and the upper joint main body 41.

Furthermore, the lower PCB 52 of the present disclosure may be mounted on the lower joint main body 51 in the following modes, specifically: the lower joint main body 51 is buckled with a fixing retaining ring 53 located at an upper end side of the lower PCB 52; the fixing retaining ring 53 is in an annular shape and is mounted on the periphery of the mounting shaft 2 in a sleeving mode; and the lower PCB 52 is clamped and fastened between the fixing retaining ring 53 and the lower joint main body 51.

Figure 8:
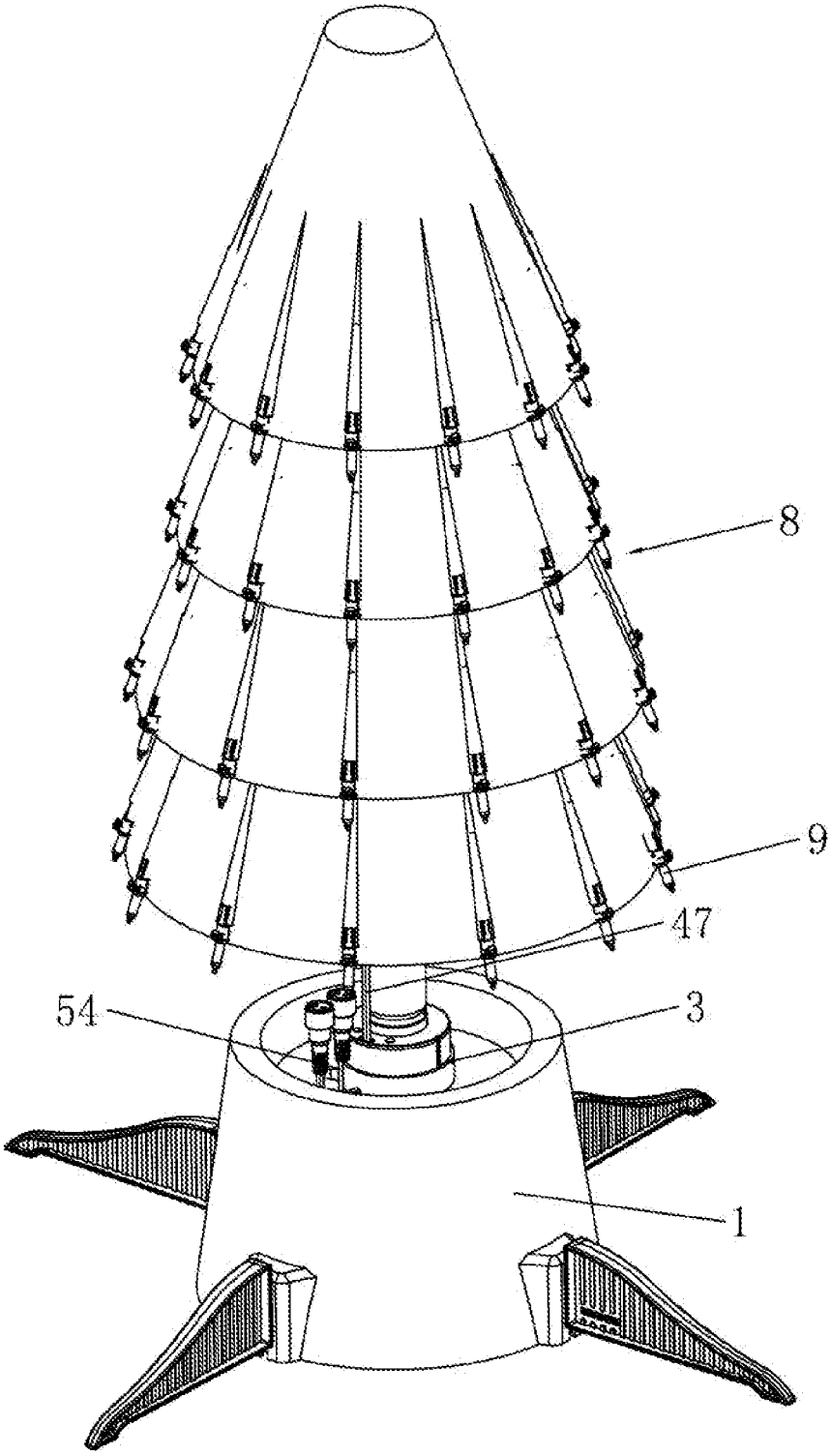
FIG. 8 is a schematic structural diagram of an artificial tree of the present disclosure.
Figure 9:
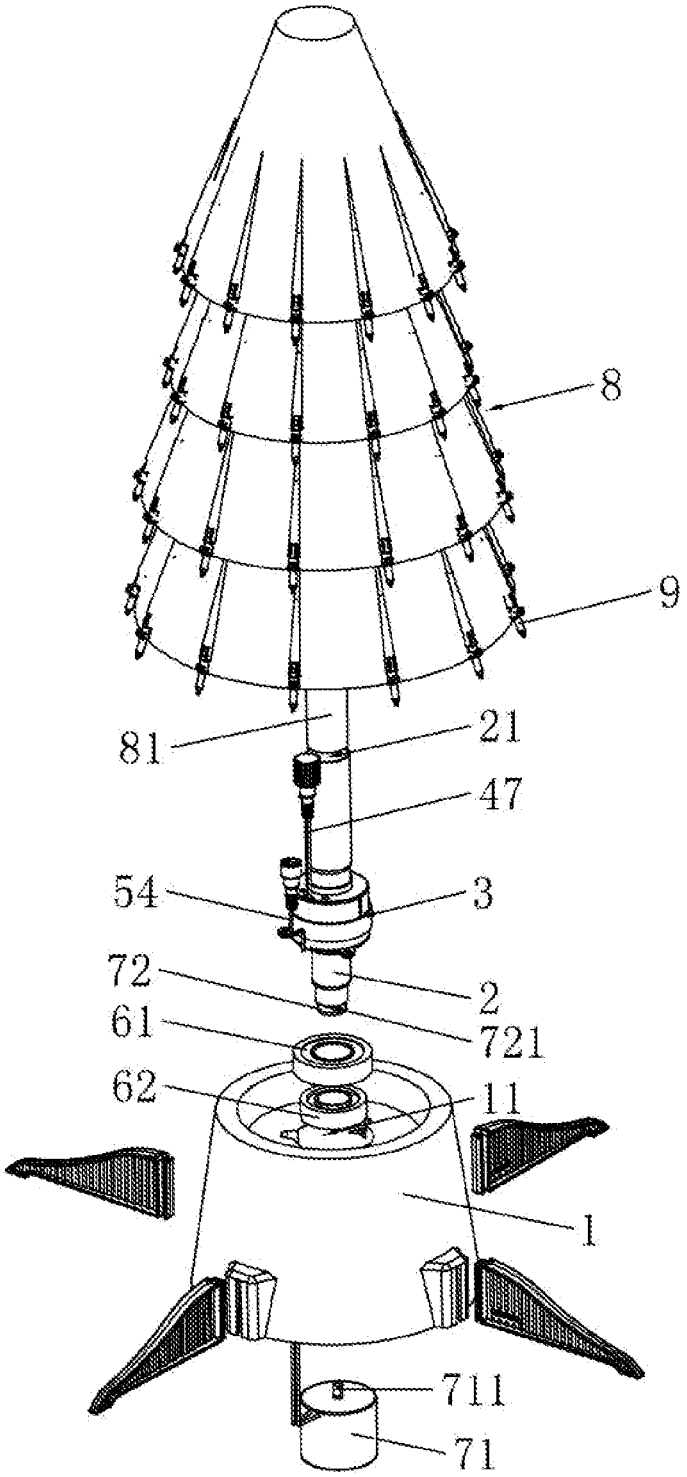
FIG. 9 is a schematic exploded diagram of the artificial tree of the present disclosure.
Figure 10:
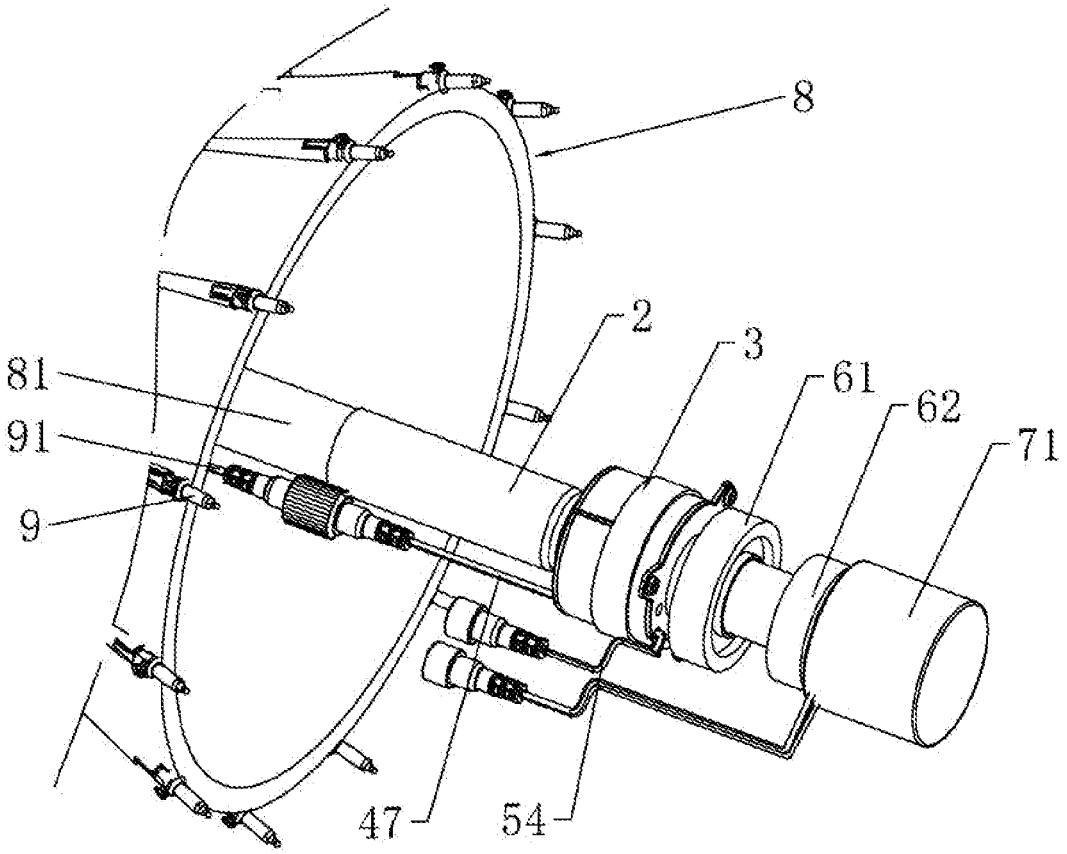
FIG. 10 is a partial schematic structural diagram of the artificial tree of the present disclosure.

As a preferred implementation mode, as shown in FIG. 8 to FIG. 10, an artificial tree includes an artificial tree main body 8, and a decorative light string 9 mounted on the artificial tree main body 8. The decorative light string 9 is provided with a light string connecting wire 91. The artificial tree main body 8 is provided with a trunk part 81.

Further, the artificial tree further includes the abovementioned rotatable electric mounting base. The upper joint connecting wire 47 and the light string connecting wire 91 are connected through a butt joint and realize electrical conduction. The trunk part 81 of the artificial tree main body 8 is connected to the upper end of the mounting shaft 2.

Furthermore, an insertion hole 21 with an upward opening is formed in the core of the mounting shaft 2. The trunk part 81 of the artificial tree main body 8 is inserted into the insertion hole 21 of the mounting shaft 2.

It is to be explained that, during mounting and connecting the artificial tree of the present disclosure, the trunk part 81 of the artificial tree is aligned with and inserted into the insertion hole 21 of the mounting shaft 2, and then the light string connecting wire 91 of the decorative light string 9 is connected to the upper joint connecting wire 47. The mounting and connecting are convenient.

In addition, the electric mounting base has the advantages of good stability and reliability, that is, the artificial tree also has the advantages of good stability and reliability.

The above content is only preferred embodiments of the present disclosure. For those of ordinary skill in the art, according to the idea of the present disclosure, there will be changes in the specific implementation mode and application scope, and the contents of this specification should not be construed as a limitation to the present disclosure.

What is claimed is:

1. A rotatable electric mounting base, comprising a base main body (1) and a mounting shaft (2) arranged in the vertical direction, wherein a main body mounting hole (11) which completely penetrates up and down is formed in the central position of the base main body (1); a lower end of the mounting shaft (2) is inserted into the main body mounting hole (11) of the base main body (1); the base main body (1) is provided with a driving motor (71); the driving motor (71) is connected to the mounting shaft (2) and drives the same;

an electric device (3) is mounted on the periphery of the mounting shaft (2) in a sleeving mode; the electric device (3) comprises an upper joint component (4) and a lower joint component (5) that is located on a lower end side of the upper joint component (4) and is matched with the upper joint component (4); the upper joint component (4) comprises an upper joint main body (41) mounted on the periphery of the mounting shaft (2) in a sleeving mode; the lower joint component (5) comprises a lower joint main body (51) that connected to a lower end of the upper joint main body (41) in a sleeving mode for rotating circumferentially at 360° and is mounted on the periphery of the mounting shaft (2) in a sleeving mode; the lower joint main body (51) is buckled and fastened to the base main body (1); the upper joint main body (41) and the lower joint main body (51) are respectively plastic insulating pieces;

the upper joint main body (41) is provided with an upper joint connecting wire (47) and an upper electric connecting piece that is in an annular shape and is arranged horizontally; the upper joint connecting wire (47) is electrically connected to the upper electric connecting piece; the lower joint main body (51) is provided with a lower joint connecting wire (54) and a lower electric connecting piece that is in an annular shape and is arranged horizontally; the lower electric connecting piece is electrically connected to the lower joint connecting wire (54);

the upper joint component (4) is provided with a conductive component at the lower end side of the upper electric connecting piece; the conductive component comprises a metal conductive spring (451) and a metal conductive pin (452) located on the lower end side of the metal conductive spring (451); the lower end of the metal conductive spring (451) is pressed against the upper end of the metal conductive pin (452); the upper end of the metal conductive spring (451) is pressed against and is electrically conducted with the upper electric connecting piece; and the lower end of the metal conductive pin (452) is in contact with the lower electric connecting piece and is electrically conducted with the lower electric connecting piece.

2. The rotatable electric mounting base according to claim 1, wherein the upper electric connecting piece is an upper Printed Circuit Board (PCB) (42) that is in an annular shape and is arranged horizontally; an upper inner conductive layer (421) and an upper outer conductive layer (422) which are respectively in annular shapes are arranged on a lower surface of the upper PCB (42); the upper inner conductive layer (421) and the upper outer conductive layer (422) are arranged at an interval; the upper joint connecting wire (47) is electrically connected to each of the upper inner conductive layer (421) and the upper outer conductive layer (422);

the lower electric connecting piece is a lower PCB (52) that is in an annular shape and is arranged horizontally; a lower inner conductive layer (521) and a lower outer conductive layer (522) which are respectively in annular shapes are arranged on an upper surface of the lower PCB (52); the lower inner conductive layer (521) and the lower outer conductive layer (522) are arranged at an interval; the lower joint connecting wire (54) is electrically connected to each of the lower inner conductive layer (521) and the lower outer conductive layer (522); the upper inner conductive layer (421) and the lower inner conductive layer (521) are aligned in the vertical direction; and the upper outer conductive layer (422) and the lower outer conductive layer (522) are aligned in the vertical direction;

the conductive component comprises an inner conductive component (43) and an outer conductive component (44); the inner conductive component (43) and the outer conductive component (44) respectively comprise a metal conductive spring (451) and a metal conductive pin (452) located on the lower end side of the metal conductive spring (451); the lower end of each metal conductive spring (451) is pressed against the upper end of the corresponding metal conductive pin (452); the upper end of the metal conductive spring (451) of the inner conductive component (43) is pressed against the lower inner conductive layer (421); the lower end of the metal conductive pin (452) of the inner conductive component (43) is in contact with the lower inner conductive layer (521); the upper end of the metal conductive spring (451) of the outer conductive component (44) is pressed against the upper outer conductive layer (422); and the lower end of the metal conductive pin (452) of the outer conductive component (44) is in contact with the lower outer conductive layer (522).

3. The rotatable electric mounting base according to claim 1, wherein an upper bearing (61) and a lower bearing (62) located on a lower end side of the upper bearing (61) are mounted at the lower end of the mounting shaft (2) in a sleeving mode; a main body upper shoulder (121) and a main body lower shoulder (122) located on a lower end side of the main body upper shoulder (121) are arranged on an inner wall of the main body mounting hole (11); the upper bearing (61) is pressed against and limited at the main body upper shoulder (121); and the lower bearing (62) is pressed against and limited at the main body lower shoulder (122).

4. The rotatable electric mounting base according to claim 1, wherein the driving motor (71) is screwed and fastened to the lower end of the base main body (1); and a power output shaft of the driving motor (71) is connected to the lower end of the mounting shaft (2) and drives the same.

5. The rotatable electric mounting base according to claim 4, wherein a driving piece (72) is welded at the lower end of the mounting shaft (2); a D-shaped hole (721) is formed in the central position of the driving piece (72); a flat part (711) consistent with the shape of the D-shaped hole (721) is arranged at the upper end of a power output shaft of the driving motor (71); and the flat part (711) of the power output shaft of the driving motor (71) is inserted into the D-shaped hole (721) of the driving piece (72).

6. The rotatable electric mounting base according to claim 1, wherein the upper inner conductive layer (421) and the upper outer conductive layer (422) are respectively metal conductive layers arranged on the lower surface of the upper PCB (42); and the lower inner conductive layer (521) and the lower outer conductive layer (522) are respectively metal conductive layers arranged on the upper surface of the lower PCB (52).

7. The rotatable electric mounting base according to claim 1, wherein the upper joint main body (41) is provided with component mounting holes (411) corresponding to the inner conductive component (43) and the outer conductive component (44) respectively; the inner conductive component (43) and the outer conductive component (44) are respectively embedded into the component mounting holes (411);

a main body limiting shoulder (4111) is formed on an inner wall of each component mounting hole (411); each metal conductive pin (452) is provided with a conductive pin limiting shoulder (4521); and the conductive pin limiting shoulder (4521) of each metal conductive pin (452) is located on an upper end side of the corresponding main body limiting shoulder (4111).

8. The rotatable electric mounting base according to claim 1, wherein an upper joint cover body (46) mounted on the periphery of the mounting shaft (2) in a sleeving mode is screwed and fastened to the upper joint main body (41); the upper PCB (42) is clamped and fixed between the upper joint cover body (46) and the upper joint main body (41);

the lower joint main body (51) is buckled with a fixing retaining ring (53) located at an upper end side of the lower PCB (52); the fixing retaining ring (53) is in an annular shape and is mounted on the periphery of the mounting shaft (2) in a sleeving mode; and the lower PCB (52) is clamped and fastened between the fixing retaining ring (53) and the lower joint main body (51).

9. An artificial tree, comprising an artificial tree main body (8), and a decorative light string (9) mounted on the artificial tree main body (8), wherein the decorative light string (9) is provided with a light string connecting wire (91); the artificial tree main body (8) is provided with a trunk part (81);

the artificial tree further comprises the rotatable electric mounting base according to any one of claims 1 to 8; the upper joint connecting wire (47) and the light string connecting wire (91) are connected through a butt joint and realize electrical conduction; and the trunk part (81) of the artificial tree main body (8) is connected to the upper end of the mounting shaft (2).

10. The artificial tree according to claim 9, wherein an insertion hole (21) with an upward opening is formed in the core of the mounting shaft (2); and the trunk part (81) of the artificial tree main body (8) is inserted into the insertion hole (21) of the mounting shaft (2).

* * * * *